US010442666B2

(12) United States Patent
Aulbach et al.

(10) Patent No.: US 10,442,666 B2
(45) Date of Patent: Oct. 15, 2019

(54) LIFTING MAST OF AN INDUSTRIAL TRUCK

(71) Applicant: Linde Material Handling GmbH, Aschaffenburg (DE)

(72) Inventors: Holger Aulbach, Goldbach (DE); Steffen Geissler, Kahl am Main (DE); Stephen Schmidt, Bruchkoebel (DE); Heiko Eizenhöfer, Mombris (DE); Johannes Hössbacher, Darmstadt (DE)

(73) Assignee: Linde Material Handling GmbH, Aschaffenburg (DE)

( * ) Notice: Subject to any disclaimer, the term of this patent is extended or adjusted under 35 U.S.C. 154(b) by 329 days.

(21) Appl. No.: 15/348,532

(22) Filed: Nov. 10, 2016

(65) Prior Publication Data

US 2017/0129755 A1 May 11, 2017

(30) Foreign Application Priority Data

Nov. 11, 2015 (DE) ..... 10 2015 119 469

(51) Int. Cl.
*B66F 9/08* (2006.01)
*B66F 9/22* (2006.01)

(52) U.S. Cl.
CPC . *B66F 9/08* (2013.01); *B66F 9/22* (2013.01)

(58) Field of Classification Search
CPC ..... B66F 9/08; B66F 9/22
See application file for complete search history.

(56) References Cited

U.S. PATENT DOCUMENTS

| | | | | |
|---|---|---|---|---|
| 3,972,388 | A | 8/1976 | McVeen | |
| 6,116,577 | A * | 9/2000 | McCanse | B66F 9/08 254/2 B |
| 9,045,321 | B2 * | 6/2015 | Ford | B66F 9/07513 |
| 2011/0206489 | A1 | 8/2011 | Ford et al. | |

FOREIGN PATENT DOCUMENTS

| | | | |
|---|---|---|---|
| CN | 201136760 | Y | 10/2008 |
| CN | 201670699 | U | 12/2010 |
| CN | 202575892 | U | 12/2012 |
| CN | 102963845 | A | 3/2013 |
| DE | 1246571 | | 8/1967 |
| DE | 2617785 | A1 | 11/1976 |

* cited by examiner

*Primary Examiner* — Diem M Tran
(74) *Attorney, Agent, or Firm* — The Webb Law Firm

(57) ABSTRACT

A lifting mast of an industrial truck includes two vertical rails at a distance from each other that are connected with one another by two cross members, wherein the lifting mast, to raise and lower a lifting carriage on the vertical rails, is provided with a lifting cylinder device which is supported on the bottom cross member, wherein the lifting cylinder device is in an operational connection with a lifting arrangement that is fastened with a first end to the lifting carriage, is fastened with a second end to the lifting mast, and is reversed on the lifting cylinder device. The second end of the lifting arrangement is fastened to the bottom cross member, or the lifting arrangement is fastened with the second end to the additional cross member, wherein at least one traction device that transmits a tractive force connects the additional cross member with the bottom cross member.

15 Claims, 7 Drawing Sheets

LIFTING MAST OF AN INDUSTRIAL TRUCK

CROSS REFERENCE TO RELATED APPLICATION

This application claims priority to German Patent Application No. DE 10 2015 119 469.4, filed Nov. 11, 2015, the disclosure of which is hereby incorporated by reference in its entirety.

BACKGROUND OF THE INVENTION

Field of the Invention

This invention relates to a lifting mast of an industrial truck that has two vertical rails separated laterally from each other that are connected with each other by means of at least two cross members, in which one of the two cross members is a bottom cross member that is located in the bottom area of the vertical rails and at least one additional cross member that is at a distance in the vertical direction of the lifting mast from the bottom cross member, in which a longitudinally displaceable lifting carriage provided with load handling means is located in the vertical rails, and, to raise and lower the lifting carriage on the vertical rails, the lifting mast is provided with a lifting cylinder device that is supported on the bottom cross member, in which the lifting cylinder device is operationally connected with lifting means that are fastened with a first end to the lifting carriage and with a second end to the lifting mast and are reversed on the lifting cylinder device.

Description of Related Art

Lifting masts of this type can be in the form of a single-section lifting frame (also called a simplex lifting frame) or in the form of a telescoping mast of a multi-section lifting frame, such as a duplex lifting frame, that includes one stationary mast and one telescoping mast, or a triplex lifting frame that includes one stationary mast and two telescoping masts. On lifting masts of this type, between the vertical rails of which a longitudinally displaceable lifting carriage equipped with load handling means is provided, a lifting cylinder device is provided that raises and lowers the lifting carriage on the vertical rails of the lifting mast. The lifting cylinder device is supported on the bottom cross member and is operationally connected with lifting means such as a lifting chain. The lifting means are fastened with a first end to the lifting carriage and with the second end to the lifting mast. The lifting means are also guided on the lifting cylinder device by means of a return pulley.

Known types of lifting masts are also used in the form of a stationary mast of a single-section lifting frame or as a telescoping mast of a multi-section lifting frame in which the two laterally separated vertical rails of the lifting mast are connected to each other by means of three cross members. A first cross member is in the form of a bottom cross member which is located in the bottom area of the vertical rails. An additional cross member is in the form of a top cross member that is located in the top area of the vertical rails. An additional cross member is in the form of a center cross member that is located in the vertical direction of the lifting mast between the bottom cross member and the top cross member. The bottom cross member supports the lifting cylinder device in the vertical direction. For this purpose, the lifting cylinder device can be supported with a cylinder base on the bottom cross member. The lifting cylinder device is fastened to the middle cross member which acts as an additional fastening point for the lifting cylinder device and optionally also performs the function of protecting the lifting cylinder device against buckling. The lifting means reversed on the lifting cylinder device are therefore fastened with the second end to the middle cross member. The middle cross member therefore absorbs the tractive force of the lifting means. On a lifting mast of this type, twice the amount of the tractive force of the lifting means is supported as a result of the reversal of the lifting means on the lifting cylinder device on the cylinder base and thus on the bottom cross member. The resulting high reaction force on the bottom cross member produces a high load, in particular a high bending load, in the bottom cross member, and a disadvantageous flux of force from the bottom cross member into the vertical rails. If the bottom cross member is connected with the vertical rails by a welded connection with corresponding weld seams, this frequently leads to a disadvantageous flux of force from the bottom cross member via the weld seams into the vertical rails. The middle cross member, to which the lifting means are fastened with the second end, is also subjected to a high load as a result of the tractive force of the lifting means. If the lifting cylinder device is also fastened to the middle cross member, the middle cross member must additionally absorb the forces of the fastening of the lifting cylinder device.

The prior art also includes types in which the stationary mast is a single-section lifting frame or a multi-section lifting frame in the form of a telescoping mast in which the two laterally separated vertical rails of the lifting mast are connected to each other by means of two cross members. A first cross member is in the form of a bottom cross member which is located in the bottom area of the vertical rails. An additional cross member is in the form of a top cross member which is located in the top area of the vertical rails. The bottom cross member supports the lifting cylinder device in the vertical direction. The lifting cylinder device can, for this purpose, stand upright with a cylinder base on the bottom cross member.

In one lifting mast of this type, the lifting means can be fastened with the second end to a cylinder head or a cylinder housing of the lifting cylinder device. In this case, a component that serves as an abutment for a chain latch of lifting means in the form of a lifting chain can be located on the cylinder head or the cylinder housing of the lifting cylinder device. In a configuration of this type, the tractive force of the lifting means is transmitted directly into the lifting cylinder device. When the lifting means are fastened in this manner with the second end to the cylinder head or the cylinder housing of the lifting cylinder device, the reaction force on the bottom cross member can be reduced, because the single amount of tractive force of the lifting means, which is transmitted directly into the cylinder head or the cylinder housing of the lifting cylinder device, is counteracted by twice the amount of the tractive force from the reversal of the lifting means. On a lifting mast of this type the bottom cross member is subjected to a lower load, although an additional force is applied to the lifting cylinder device. Because the lifting means are fastened with the second end at a distance from the longitudinal axis and, thus, from the axis of positive output of the lifting cylinder device to the cylinder head or the cylinder housing of the lifting cylinder device, the tractive force of the lifting means is discharged at an offset relative to the line of action of the lifting cylinder device, so that the lifting cylinder device must withstand not only the tractive force but also a torque applied by the tractive force. This can require a reinforcement of the cylinder housing, for example a reinforced wall thickness of the cylinder housing, and the sealing and guidance system of the telescoping piston rod of the lifting cylinder device must be designed to withstand the greater deformations of the lifting cylinder device.

In the embodiment cited above, a lifting mast used as the stationary mast of a single-section lifting frame or as the telescoping mast of a multi-section lifting frame, in which the two laterally separated vertical rails of the lifting mast are connected to each other by means of two cross members, in which a first cross member is in the form of a bottom cross member and an additional cross member is in the form of a top cross member, the lifting means can be fastened with the second end to one or both vertical rails. A component can thereby be located on the vertical rails, for example by welding, that serves as an abutment for a chain latch of lifting means in the form of a lifting chain. In an embodiment of this type, the tractive force of the lifting means is discharged directly into the vertical rail of the lifting mast. With a fastening of this type of the lifting means, with the second end to the vertical rail of the lifting mast, the reaction force on the bottom cross member cannot be reduced, because the bottom cross member supports double the amount of the tractive force of the lifting means as a result of the reversal of the lifting means on the lifting cylinder device. The resulting high reaction force on the bottom cross member causes a high load, in particular a high bending load, in the bottom cross member and a disadvantageous flux of force from the bottom cross member into the vertical rails. If the bottom cross member is connected with the vertical rails by a welded connection with corresponding weld seams, the result is a disadvantageous flux of force from the bottom cross member via the weld seams into the vertical rails.

SUMMARY OF THE INVENTION

The object of this invention is to make available a lifting mast of the type described above that is improved in terms of loads and flux of force.

This object is accomplished by the invention in that the second end of the lifting means is fastened to the bottom cross member, or in that the lifting means are fastened with the second end to the additional cross member, in which at least one traction means that transmits tractive force is provided that connects the additional cross member with the bottom cross member. The fastening of the second end of the lifting means directly to the bottom cross member according to the invention results in a reduction of loads on the bottom cross member, because the single amount of the tractive force of the lifting means that is transmitted directly into the bottom cross member counteracts the double amount of the tractive force from the reversal of the lifting means. The load on the additional cross member is also relieved because no tractive force is transmitted to the additional cross member by the lifting means. In addition, with a fastening of this type of the lifting means with the second end to the bottom cross member, a greater load on the lifting cylinder device and torque on the lifting cylinder device is avoided. The fastening of the second end of the lifting means to the bottom cross member can be direct or indirect. Alternatively, the lifting means can be fastened with the second end to the additional cross member and, according to the invention, at least one traction means that transmits tractive force is provided that connects the additional cross member with the bottom cross member. The bottom cross member and the additional cross members to which the lifting means are fastened and into which the tractive force of the lifting means is transmitted are therefore, according to the invention, connected with one another by one or more traction means that transmit tractive forces. The at least one traction means that transmits tractive forces makes it possible for a portion of the tractive force of the lifting means from the additional cross member to be transmitted directly into the bottom cross member. As a result, a lower load is born by the bottom cross member, as well as by the additional cross members. If the bottom cross member and the additional cross members are connected by means of a welded connection with the vertical rails of the lifting mast, the at least one traction means that transmits a tractive force between the additional cross members and the bottom cross members also results in a lower load on the weld seams of these welded connections. As a result of the at least one traction means that transmits a tractive force between the additional cross member and the bottom cross member, only a portion of the tractive force acts on the additional cross member, and, on the bottom cross member, the force transmitted by means of the at least one traction means that transmits a tractive force directly counteracts the vertical force of the lifting cylinder device. Consequently, the load, in particular the bending load, on the bottom cross member is reduced. The lifting mast according to the invention is therefore an improvement in terms of loads and the distribution of forces.

In one preferred embodiment of the invention, a fastening point of the lifting means on the additional cross member and a fastening point of the at least one traction means on the additional cross member are aligned with one another in the transverse direction of the lifting mast. The result is a favorable position of the at least one traction means relative to the point of introduction of the tractive force of the lifting means formed by the fastening point of the lifting means that has a favorable effect on the bending load and torsion load of the additional cross member.

In one preferred embodiment of the invention, two traction means that transmit tractive forces are located symmetrically in the transverse direction of the lifting mast with reference to the fastening point of the lifting means on the additional cross member. The result is a favorable symmetrical position of the two traction means relative to the point of introduction of the tractive force of the lifting means formed by the fastening point of the lifting means, which has a favorable effect on the bending load and torsion load of the additional cross member.

In one preferred embodiment of the invention, a contact area of the lifting cylinder device is located on a side of the bottom cross member facing the lifting carriage and a fastening point of the lifting means or a fastening point of the at least one traction means is located on the cross member on a side of the cross member facing away from the lifting carriage. This creates a favorable position of the lifting means or of the at least one traction means relative to the point of engagement of the vertical force of the lifting cylinder device formed by the contact surface of the lifting cylinder device, which has a favorable effect on the bending load and torsion load of the bottom cross member.

If the lifting cylinder device is located with the lifting means that are reversed on the lifting cylinder device between the two vertical rails, preferably essentially centrally between the two vertical rails, there are advantages with regard to a low bending load and torsion load of the additional cross member and of the bottom cross member if the at least one traction means that transmits tractive forces is located between the vertical rails of the lifting mast.

In one advantageous embodiment of the invention, the at least one traction means transmitting a tractive force can be in the form of a cable, belt or chain.

In an alternative and preferred embodiment of the invention, the at least one traction means that transmits tractive forces can be in the form of a metal section, in particular a rod-shaped metal section.

The metal section can be in the form of a connecting rod, in particular a round rod with a cylindrical cross-section, or a threaded rod, a metal tube or a steel bar or a preformed sheet metal part.

In one advantageous embodiment of the invention, the at least one traction means that transmits a tractive force can be connected with the bottom cross member and/or the additional cross member by means of a threaded connection. With threaded connections, by means of which the traction means are fastened to the bottom cross member and the additional cross member, a controlled pre-stressing of the at least one traction means is possible. It thereby becomes possible to reduce the maximum deformation and/or the maximum component stresses on the bottom cross member and the additional cross member. If the bottom cross member and the additional cross member are each welded with the two vertical rails of the lifting mast, pre-stressing of the at least one traction means also achieves a reduction of the maximum stresses in the weld seams of the welded connections of the bottom cross member and the additional cross member with the rail profiles.

In an alternative and likewise advantageous configuration of the invention, the at least one traction means that transmits a tractive force can be connected with the bottom cross member and/or the additional cross member by means of a welded connection. This arrangement makes possible an economical fastening of the traction means to the bottom cross member and/or to the additional cross member.

There are additional advantages if, as in one development of the invention, the weld seam preparation of the weld joints is performed on the bottom cross member and/or the additional cross member. For the welded connections and the laying down of their weld seams, no changes or processes need to be carried out on the traction means in the form of a preformed metal section, so that the traction means in the form of a preformed metal section need only be cut to the appropriate length and deburred on the ends.

In an additional advantageous embodiment of the invention, the lifting cylinder device is fastened to the additional cross member. Therefore, the additional cross member performs the function of an additional fastening point of the lifting cylinder device and/or the function of protection of the lifting cylinder device against buckling.

The lifting cylinder device is advantageously located between the vertical rails, in particular, essentially centrally between the vertical rails.

If, as in one development of the invention, the at least one traction means that transmits a tractive force is located inside the transverse dimension of the lifting cylinder device, there are particular advantages with regard to visibility through the lifting mast. If the at least one traction means are located inside the transverse dimension of the lifting cylinder device, the at least one traction means do not pose any additional obstacle to the ability of an operator of the industrial truck to see through the lifting mast according to the invention.

The additional cross member can be in any arbitrary shape and can be formed by a plate. In one advantageous embodiment of the invention, the additional cross member is in the shape of an X. An additional cross member of this type results in the improved ability of an operator to see through the lifting mast, because an X-shaped cross member forms two lateral visual openings that give the operator an improved view of the load handling means, for example, of the tips of the forks of a load handling means that has two load forks.

On the lifting mast according to the invention, the lifting means can be in the form of a lifting chain, lifting belt, or lifting cable.

BRIEF DESCRIPTION OF THE DRAWINGS

Additional advantages and details of the invention are described below with reference to the exemplary embodiment illustrated in the accompanying schematic figures, in which:

FIG. 1 is a perspective view of a lifting mast of the prior art;

DESCRIPTION OF THE DISCLOSURE

Figure 2:
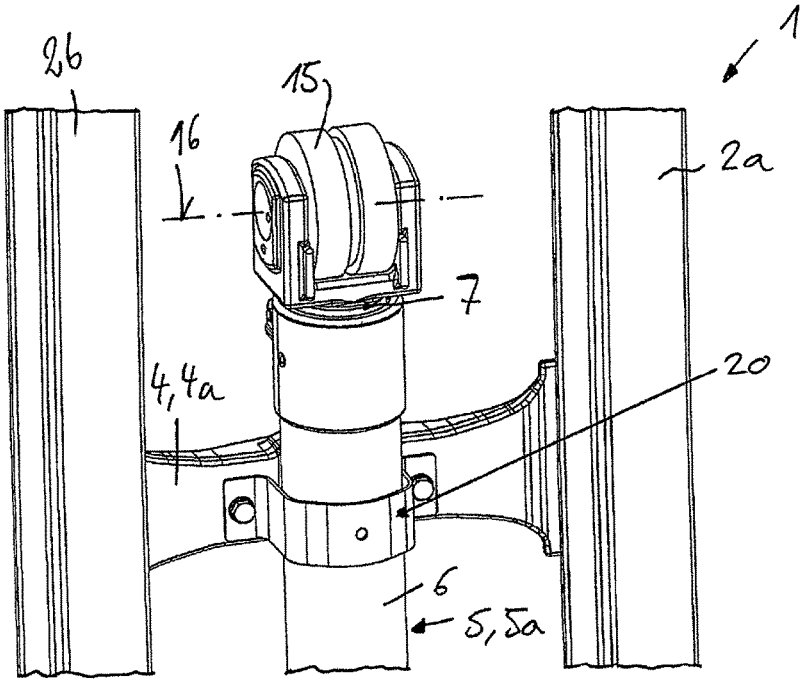
Fig.2 (Prior Art)
FIG. 2 is an enlarged detail view of the lifting mast of FIG. 1.
Figure 3:
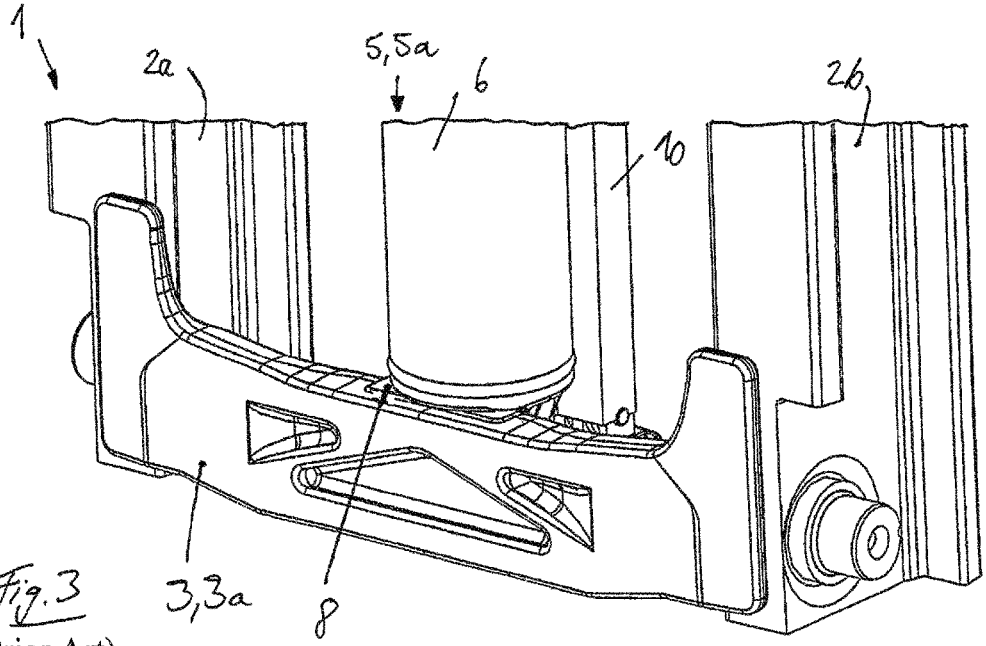
Fig. 3 (Prior Art)
FIG. 3 is an additional enlarged detail view of the lifting mast of FIG. 1.

FIGS. 1 to 3 show a lifting mast 1 of an industrial truck of the prior art.

The lifting mast 1 illustrated in FIGS. 1 to 3 has two vertical rails 2*a*, 2*b* which are at a distance from each other in the transverse direction QR of the lifting mast 1. The two vertical rails 2*a*, 2*b* are connected to each other by means of three or more than three cross members 3, 4. A first cross member 3 is located in the vertically lower bottom area of the two vertical rails 2*a*, 2*b* and is in the form of a bottom cross member 3*a*. A second cross member 4 is at a distance from the bottom cross member 3*a* in the vertical direction VR of the lifting mast 1 and is in the form of a middle cross member 4*a*. A third cross member 3, which is located in the vertically upper area of the two vertical rails 2*a*, 2*b* and is in the form of a top cross member 3*a*, is not illustrated in any further detail. The cross members 3, 4 are preferably connected with the vertical rails 2*a*, 2*b* by welded connections. A lifting carriage that can be displaced longitudinally, i.e. can be raised and lowered, is located on the two vertical rails 2*a*, 2*b*. The lifting carriage is provided with load handling means, which are formed, for example, by a load fork with two load tips.

The lifting mast 1 is provided with a lifting cylinder device 5 to raise and lower the lifting carriage. In the illustrated exemplary embodiment, the lifting cylinder device 5 is formed by a single lifting cylinder 5*a* that has a cylinder housing 6 that is fastened to the lifting mast 1 and a telescoping piston rod 7. The lifting cylinder 5*a* is oriented vertically upright and, in the illustrated exemplary embodiment, is located in the transverse direction QR of the lifting mast 1 between the two vertical rails 2*a*, 2*b*, preferably essentially centrally between the two vertical rails 2*a*, 2*b*. The lifting cylinder 5*a* is supported with the cylinder housing 6 on the bottom cross member 3*a*, as illustrated in detail in FIG. 3. For this purpose, a contact surface 8 is formed on the bottom cross member 3*a*, on which the lifting cylinder 5*a* is supported with a cylinder base of the cylinder housing 6.

The lifting cylinder device 5 is operatively connected with lifting means 10. The lifting means 10 in the illustrated exemplary embodiment is in the form of a lifting chain 11. The lifting means 10 is fastened with a first end 10*a* to the lifting carriage. With a second end 10*b*, the lifting means 10 is fastened to the middle cross member 4*a* of the lifting mast 1. In the illustrated exemplary embodiment, the lifting means 10 in the form of a lifting chain 11 is provided on the second end 10*b* with a chain latch 12, which is fastened by means of fastening means 13, in the illustrated exemplary embodiment, a threaded fastener, with the middle cross member 4*a*.

The lifting means 10 is reversed between the two ends 10*a*, 10*b* on the lifting cylinder device 5. The telescoping piston rod 7 of the lifting cylinder 5*a* is for this purpose provided with a return pulley 15 which is mounted so that it can rotate around an axis of rotation that runs in the transverse direction QR of the lifting mast 1. For the reversal, the lifting means 10 is guided over the return pulley 15.

The middle cross member 4*a* also forms a top support for the lifting cylinder device 5. The lifting cylinder device 5 is for this purpose fastened to the middle cross member 4*a*, for example, with a clamp 20 that surrounds the cylinder housing 6 or a cylinder head of the cylinder housing 6 as illustrated in greater detail in FIG. 2. The center cross member 4*a* therefore also has the function of an additional fastening point of the lifting cylinder device 5 and the function of anti-buckling protection of the lifting cylinder device 5.

On the lifting mast 1 of the prior art illustrated in FIGS. 1 to 3, the middle cross member 4*a* is loaded with the tractive force of the lifting means 10. As a result of the reversal of the lifting means 10 on the return pulley 15 of the lifting cylinder device 5, twice the amount of the tractive force of the lifting means 10 must be supported by the cylinder base of the cylinder housing 6 and, therefore, on the bottom cross member 3*a*. The resulting high reaction force on the bottom cross member 3*a* effects a high load, in particular a high bending load, in the bottom cross member 3*a*, and a disadvantageous flux of forces from the bottom cross member 3*a* into the vertical rails 2*a*, 2*b*. If the bottom cross member 3*a* is connected with the vertical rails 2*a*, 2*b* by a welded connection with corresponding weld seams, this leads to a disadvantageous flux of forces from the bottom cross member 3*a* via the weld seams into the vertical rails 2*a*, 2*b*. In addition, the middle cross member 4*a* on which the lifting means 10 is fastened with the second end, also experiences a high load on account of the tractive force of the lifting means 10. If the lifting cylinder device 5 is also fastened to the middle cross member 4*a*, the middle cross member 4*a* must also absorb the forces of the fastening of the lifting cylinder device 5.

Figure 4:
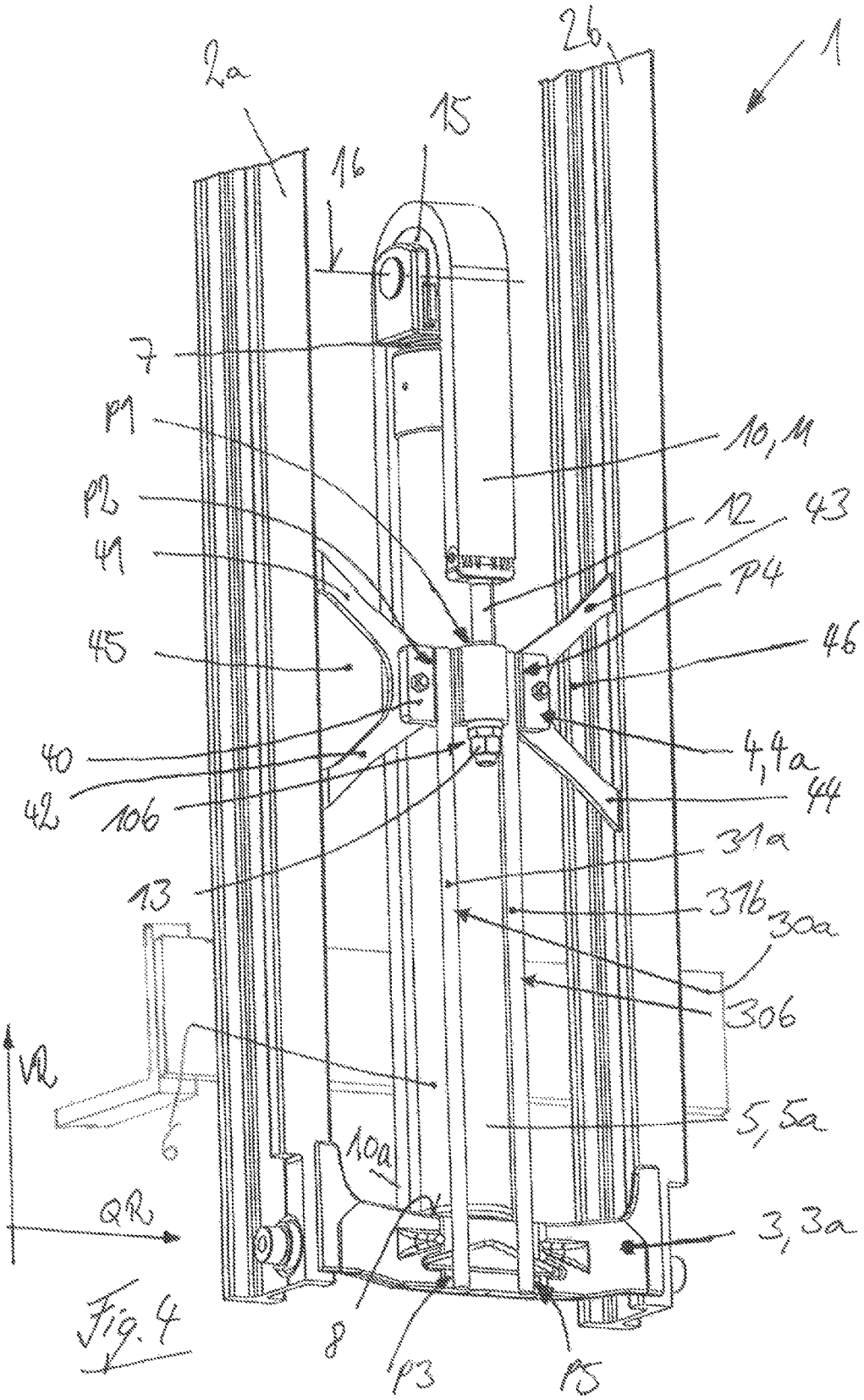
FIG. 4 is a perspective view of a lifting mast according to the invention.

FIG. 4 shows a lifting mast 1 according to the invention. Components that are identical to those illustrated in FIGS. 1 to 3 are identified by the same reference numbers.

The invention illustrated in FIG. 4 has two vertical rails 2*a*, 2*b*, at a distance from each other laterally in the transverse direction QR of the lifting mast 1. The two vertical rails 2*a*, 2*b* are connected with each other by means of three or more cross members 3, 4. A first cross member 3 is located in the vertically lower bottom portion of the two vertical rails 2*a*, 2*b*, and is in the form of a bottom cross member 3*a*. A second cross member 4 is in the form of a middle cross member 4*a* at some distance in the vertical direction VR of the lifting mast 1 from the bottom cross member 3*a*. Not illustrated in any further detail is a third cross member 3, which is located in the vertically upper part of the two vertical rails 2*a*, 2*b*, and is in the form of a top cross member 3*a*. The cross members 3, 4 are preferably connected with the vertical rails 2*a*, 2*b* by welded connections.

Located in the two vertical rails 2*a*, 2*b* is a lifting carriage not illustrated in any further detail that can be displaced longitudinally, i.e. can be raised and lowered. The lifting carriage is provided with load handling means that are formed, for example, by a load fork with two fork tips.

The lifting mast 1 is provided with a lifting cylinder device 5 to raise and lower the lifting carriage. In the illustrated exemplary embodiment, the lifting cylinder device 5 is formed by a single lifting cylinder 5*a*, which has a cylinder housing 6 that is fastened to the lifting mast 1, and an extendable and retractable piston rod 7. The lifting cylinder 5*a* is oriented vertically upright and, in the illustrated exemplary embodiment, is located in the transverse direction QR of the lifting mast 1 between the two vertical rails 2*a*, 2*b*, preferably essentially centrally between the two vertical rails 2*a*, 2*b*. The lifting cylinder 5*a* is supported with the cylinder housing 6 on the bottom cross member 3*a*. For this purpose, analogous to FIG. 3, a contact area 8 can be formed on the bottom cross member 3*a*, on which the lifting cylinder 5*a* stands upright with a cylinder base of the cylinder housing 6.

The lifting cylinder device 5 is operatively connected with lifting means 10 (also referred to as a lifting arrangement). The lifting means 10 in the illustrated exemplary embodiment is in the form of a lifting chain 11. The lifting chain 11 is fastened with a first end 10*a* to the lifting carriage. With a second end 10*b*, the lifting means 10 is fastened to the middle cross member 4*a* of the lifting mast 1 by means of a fastening point P1. In the illustrated exemplary embodiment, the lifting means 10 in the form of a lifting chain 11 is provided on the second end 10*b* with a chain latch 12, which is guided through a boring in the middle cross member 4*a* and is fastened to the middle cross member 4*a* by fastening means 13, in the illustrated embodiment, a threaded connection.

The lifting means 10 is reversed between the two ends 10*a*, 10*b* on the lifting cylinder device 5. The telescoping piston rod 7 of the lifting cylinder 5*a* is for this purpose provided with a return pulley 15 which is mounted so that it can rotate around an axis of rotation 16 that runs in the transverse direction QR of the lifting mast 1. The lifting means 10 is reversed as it is guided over the return pulley 15.

The middle cross member 4*a* also forms an upper support for the lifting cylinder device 5. For this purpose, the lifting cylinder device 5 is fastened to the middle cross member 4*a*, for example, with a clamp that surrounds the cylinder housing 6 or a cylinder head of the cylinder housing 6 analogous to FIG. 2. The middle cross member 4*a*, therefore, also has the function of an additional fastening point of the lifting cylinder device 5 and the function of an anti-buckling support of the lifting cylinder device 5.

According to the disclosure, at least one traction means 30*a*, 30*b* (also referred to as a traction device) that transmits a tractive force is provided that connects the additional cross member 4 in the form of a middle cross member 4*a* with the cross member 3 in the form of the bottom cross member 3*a*. The traction means 30*a*, 30*b* are oriented parallel to the vertical rails 2*a*, 2*b* and the lifting cylinder device 5.

In the illustrated exemplary embodiment, in which the lifting cylinder 5*a* is located essentially centrally between the two vertical rails 2*a*, 2*b*, there are two traction means 30*a*, 30*b* that transmit a tractive force and are at a distance from each other in the transverse direction QR of the lifting mast 1. The traction means 30*a* are located in the transverse direction QR of the lifting mast 1 between the fastening point P1 of the lifting means 10 on the middle cross member 4*a* and the vertical rail 2*a*. The traction means 30*b* is located in the transverse direction QR of the lifting mast 1 between the fastening point P1 of the lifting means 10 on the middle cross member 4*a* and the vertical rail 2*b*. Preferably, the two traction means 30*a*, 30*b* are located in the transverse direction QR of the lifting mast 1 symmetrically with reference to the fastening point P1 of the lifting means 10 on the middle cross member 4*a*.

The traction means 30*a* is fastened with a fastening point P2 to the middle cross member 4*a* and with a fastening point P3 to the bottom cross member 3*a*. The traction means 30*b* is fastened with a fastening point P4 to the middle cross member 4*a* and with a fastening point P5 to the bottom cross member 3*a*.

The fastening point P1 of the lifting means 10 on the middle cross member 4*a* and the fastening point P2 of the traction means 30*a*, as well as the fastening point P4 of the traction means 30*b*, are located on the middle cross member 4*a* aligned in the transverse direction QR of the lifting mast 1.

The contact surface 8 of the lifting cylinder device 5 on the bottom cross member 3*a* is located on a side of the bottom cross member 3*a* facing the lifting carriage. The fastening point P3 of the traction means 30*a* and the fastening point P5 of the traction means 30*b* on the bottom cross member 3*a* are located on a side of the bottom cross member 3*a* facing away from the lifting carriage.

In the illustrated exemplary embodiment, the traction means 30*a*, 30*b* are in the form of preformed sheet metal sections, e.g. connecting rods 31*a*, 31*b*. The connecting rods 31*a*, 31*b* preferably have a round cross-section and are in the form of round bars.

In the illustrated exemplary embodiment, the traction means 30*a*, 30*b* are connected at the fastening points P3, P5 with the bottom cross member 3*a* and at the fastening points P2, P4 with the middle cross member 4*a*, each by means of a welded connection. The weld seam preparations for the laying down of the weld seams of the welded connections between the bottom cross member 3*a*, the middle cross member 4*a*, and the traction means 30*a*, 30*b*, which can be, for example, corresponding recesses for the weld seams of the welded connections, are performed on the bottom cross member 3*a* and the middle cross member 4*a*. The connecting rods 31*a*, 31*b* in the form of round bars need only be cut to the appropriate length and deburred on the ends.

The traction means 30*a*, 30*b* are preferably located inside the transverse dimension of the lifting cylinder device 5 and, therefore, inside the diameter of the cylinder housing 6 of the lifting cylinder 5*a*.

In the illustrated exemplary embodiment, the middle cross member 4*a*, which is provided with the recesses for the traction means 30*a*, 30*b*, is in the shape of an X. The middle cross member 4*a* has a central area 40 in which the fastening point P1 of the lifting means 10 and the fastening points P2, P4 of the traction means 30*a*, 30*b* are located and to which the lifting cylinder device 5 is fastened. The middle cross member 4*a* further includes a first brace 41 that runs from the central area 40 ascending in the vertical direction to the vertical rail 2*a* and is fastened to the vertical rail 2*a*. The middle cross member 4*a* includes a second brace 42 that runs from the central area 40 descending in the vertical direction to the vertical rail 2*a* and is fastened to the vertical rail 2*a*. The middle cross member 4*a* further includes a third brace 43 that runs from the central area 40 ascending in the vertical direction to the vertical rail 2*b* and is fastened to the vertical rail 2*b*. The middle cross member 4*a* includes a fourth brace 44 that runs from the central area 40 descending in the vertical direction to the vertical rail 2*b* and is fastened to the vertical rail 2*b*. The braces 41-44 are preferably connected with the vertical rails 2*a*, 2*b* by respective weld connections. The middle cross member 4*a* that consists of the central area 40 and the braces 41-44 can be realized in one piece. In the illustrated exemplary embodiment, the middle cross member 4*a* is in multiple parts, wherein the central area 40 is formed by a component such as a forging, and the braces 41, 42 and the braces 43, 44 are each formed by an additional component, such as a laser cut sheet, that is connected with the central area 40, for example, by threaded connectors or welded connections.

The X-shaped middle cross member 4*a*, between the braces 41, 42 and the braces 43, 44, offers respective visual openings 45, 46 that extend in the lateral direction to the vertical rails 2*a* and 2*b*. These large visual openings 45, 46 allow an improved view by an operator through the lifting mast 1 that makes it possible for the operator to have a better view of the load handling means, for example, the tips of the load forks of a load handling means that has two fork tips.

On the lifting mast 1 according to the disclosure, the bottom cross member 3*a* and the middle cross member 4*a* on which the lifting means 10 are fastened and into which the tractive force of the lifting means 10 is discharged, are connected with each other by one or more traction means 30*a*, 30*b* that transmit tractive forces. The at least one traction means 30*a*, 30*b* that transmit tractive forces make it possible for a component of the tractive force of the lifting means 10 that is discharged at the fastening point P1 into the middle cross member 4*a* to be transmitted from the middle cross member 4*a* directly into the bottom cross member 3*a*. Consequently, the load on both the bottom cross member 3*a* as well as the middle cross member 4*a* is reduced. If the bottom cross member 3*a* and the middle cross member 4*a* are connected by means of a welded connection with the vertical rails 2*a*, 2*b* of the lifting mast 1, the at least one traction means 30*a*, 30*b* that transmits a tractive force between the middle cross member 4*a* and the bottom cross member 3*a* also results in a reduced load on the weld seams of these welded connections. As a result of the at least one traction means 30*a*, 30*b* that transmits tractive forces between the middle cross member 4*a* and the bottom cross member 3*a*, only a portion of the tractive force of the lifting means 10 acts on the middle cross member 4*a* as a resultant force, and, on the bottom cross member 3*a*, the force discharged by means of the at least one traction means 30*a*, 30*b* that transmits a tractive force directly counteracts the vertical force of the lifting cylinder device 5 that is discharged into the contact surface 8. The load on the bottom cross member 3*a*, and particularly the bending load, is thereby reduced.

As a result of the reduced loads on the bottom cross member 3*a* and the middle cross member 4*a*, the bottom cross member 3*a* and the middle cross member 4*a* can be smaller and lighter in weight, as a result of which the view through the lifting mast 1 according to the invention can be further improved. The bottom cross member 3*a* is preferably a forged component.

The location and positioning of the fastening points P2-P5 of the traction means 30*a*, 30*b* relative to the fastening point P1 of the lifting means 10 described above and thus the point of application of the tractive force of the lifting means 10 on the middle cross member 4*a* and relative to the contact surface 8 of the lifting cylinder device 5 and thus the point of application of the vertical force of the lifting cylinder device 5 on the bottom cross member 3*a*, make it possible to reduce the effective bending loads and torsion loads on the bottom cross member 3*a* and on the middle cross member 4*a*.

On the lifting mast 1 according to the invention, the flux of forces is advantageously engineered so that the middle cross member 4*a* and the bottom cross member 3*a* and the weld seams with which the middle cross member 4*a* and the bottom cross member 3*a* are connected with the vertical rails 2*a*, 2*b* are subjected to lower loads. The middle cross member 4*a* and the bottom cross member 3*a* can be smaller and lighter-weight, which achieves an improved view through the lifting mast 1.

The invention is not limited to the exemplary embodiment illustrated in FIG. 4.

Instead of the construction of the lifting cylinder device 5 with a single lifting cylinder 5*a* and a single lifting means 10, the lifting cylinder device 5 can be formed by a plurality of lifting cylinders 5*a* and a plurality of lifting means 10.

As an alternative to the realization of the lifting means 10 in the form of a lifting chain 11, the lifting means 10 can also be in the form of lifting belts or a lifting cable.

Figure 7:
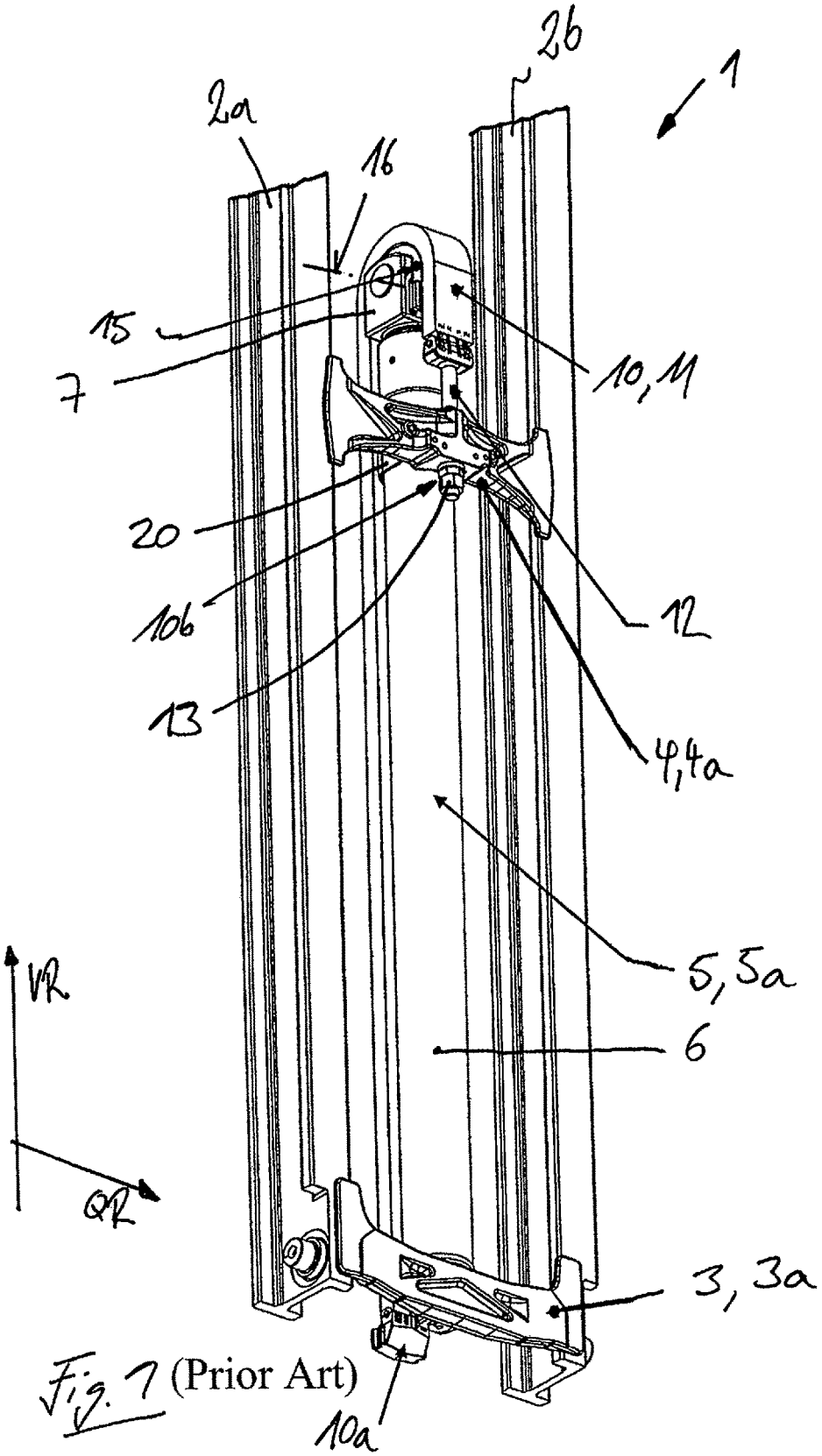
Fig. 7 (Prior Art)
FIG. 7 is a perspective view of a lifting mast according to another example of the invention.
Figure 5:
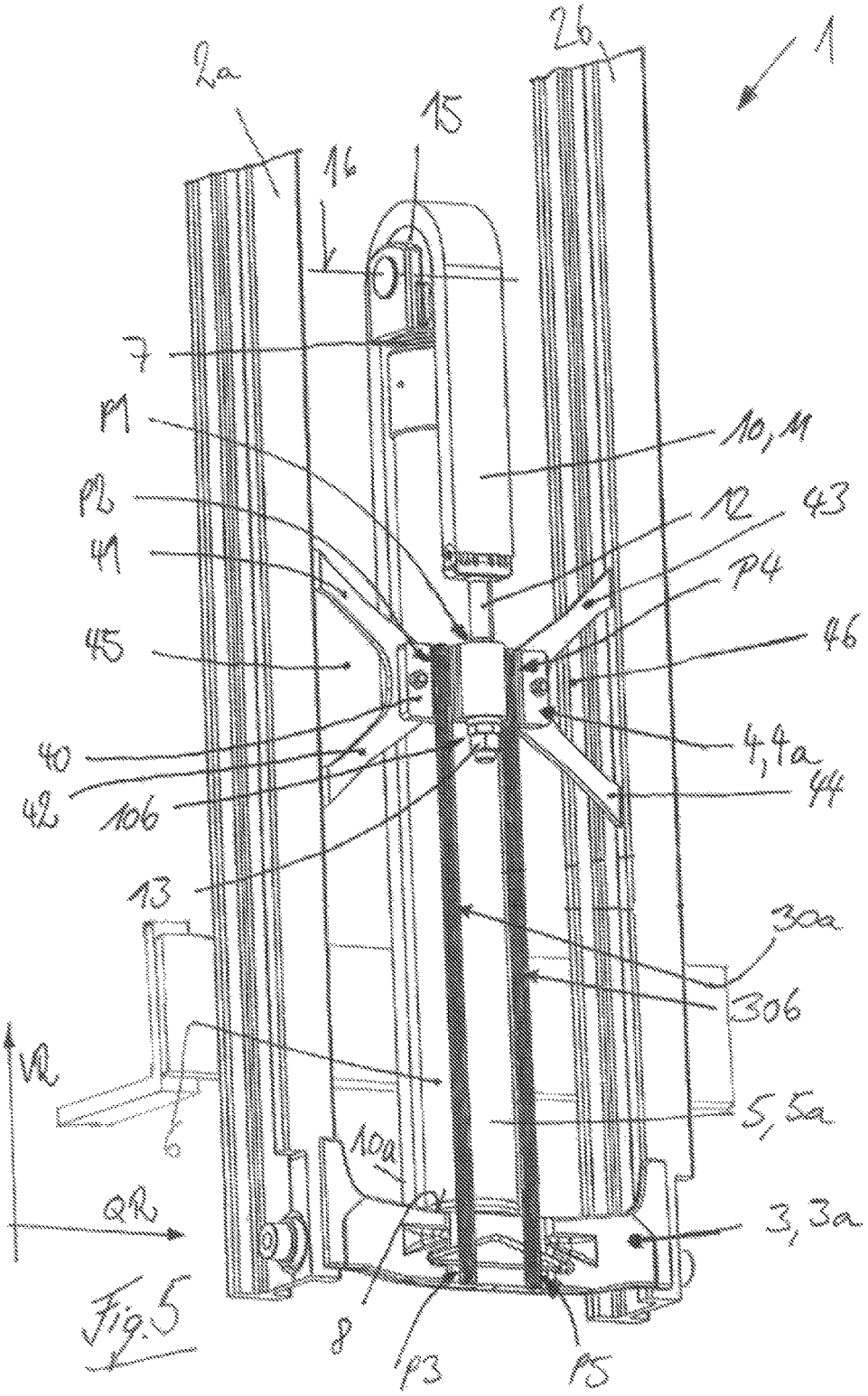
FIG. 5 is a perspective view of a lifting mast according to another example of the invention.
Figure 6:
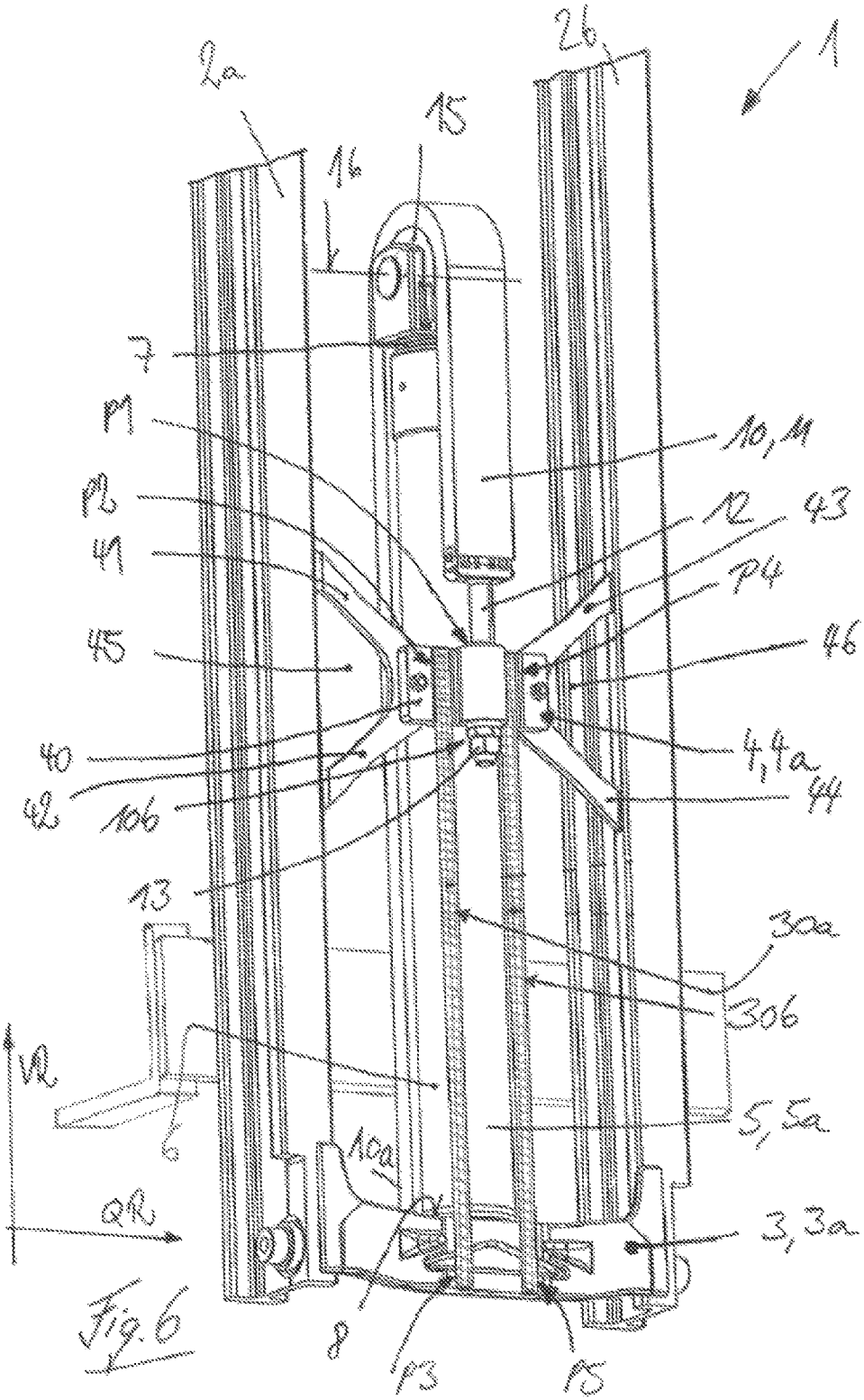
FIG. 6 is a perspective view of a lifting mast according to another example of the invention.
Figure 7:
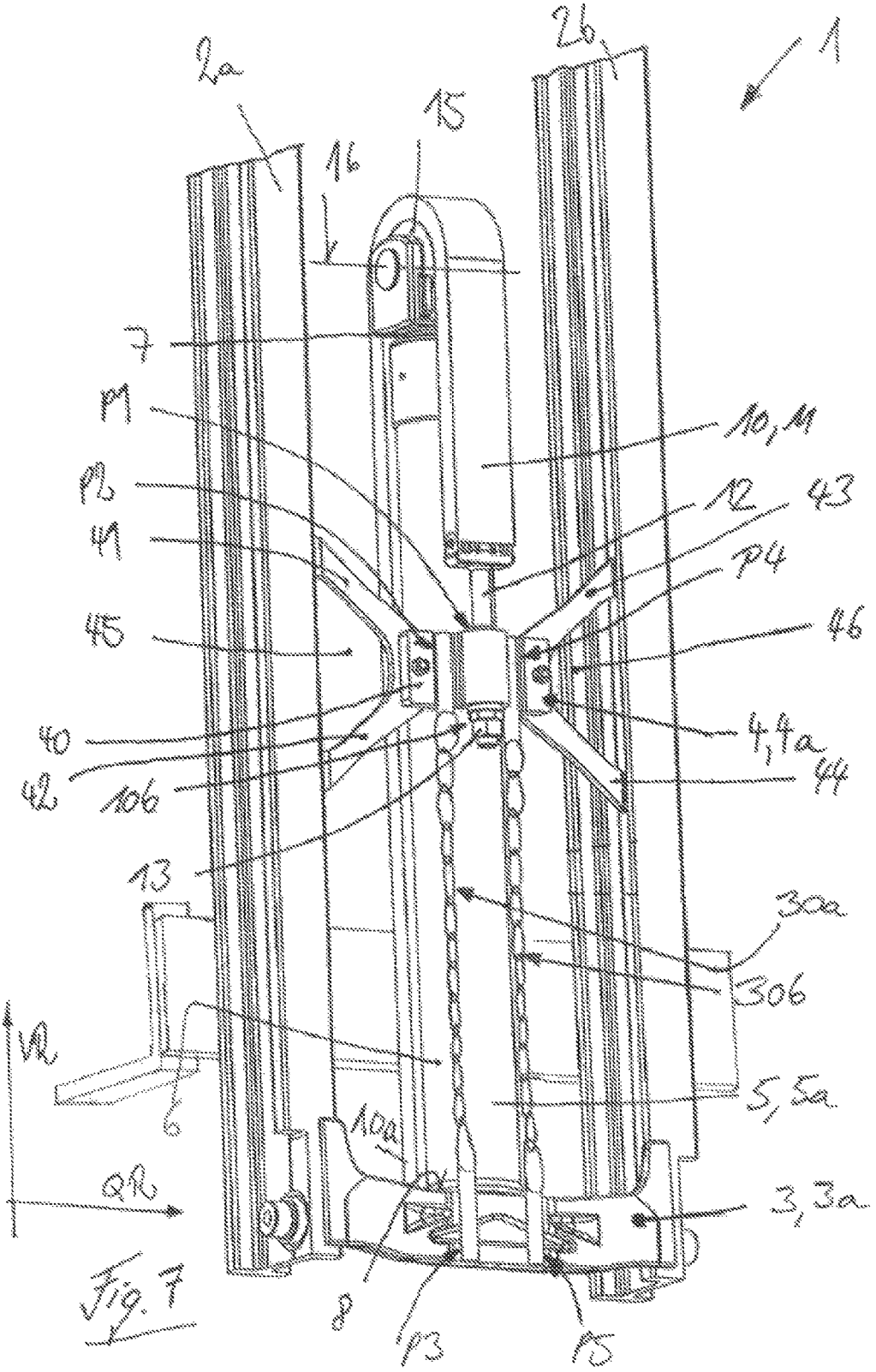

The traction means 30*a*, 30*b* in the form of connecting rods 31*a*, 31*b*, instead of being in the form of round rods, can alternatively be in the form of rods with a polygonal, for example, a rectangular cross-section, a metal tube, a preformed sheet metal section or a steel bar. It is also possible to realize the traction means 30*a*, 30b in the form of a cable, a belt, or a chain (see FIGS. 5-7).

As an alternative to the welded connections with which the traction means 30*a*, 30*b* are fastened to the bottom cross member 3*a* and the middle cross member 4*a*, threaded connections can be provided to fasten the traction means 30*a*, 30*b* to the bottom cross member 3*a* and to the middle cross member 4*a*.

In an alternative embodiment of the invention, it is also possible, instead of the fastening of the lifting means 10 to the middle cross member 4*a* and the connection of the middle cross member 4*a* with the bottom cross member 3*a* by the traction means 30*a*, 30*b*, to fasten the second end 10*b* of the lifting means 10 directly or indirectly to the bottom cross member 3*a*. For this purpose, the lifting means 10 or the chain latch 12 can be appropriately extended so that the fastening point P1 at which the tractive force of the lifting means 10 is discharged can be realized directly on the bottom cross member 3*a*. Alternatively, the second end 10*b* of the lifting means 10 or the chain latch 12 can be connected by means of at least one traction means with the bottom cross member 3*a* and fastened to the bottom cross member 3*a* indirectly by means of the traction means. Compared to FIG. 4, this configuration results in an additional reduction of the load on the middle cross member 4*a*.

The lifting mast 1 according to the invention can be in the form of a stationary mast of a simplex lifting frame or a telescoping mast of a multiple story lifting frame, for example a duplex lifting frame, or a triplex lifting frame.

It will be readily appreciated by those skilled in the art that modifications may be made to the invention without departing from the concepts disclosed in the foregoing description. Accordingly, particular embodiments described in detail herein are illustrative only and are not limiting to the scope of the invention, which is to be given the full breadth of the appended claims and any and all equivalents thereof.

The invention claimed is:

1. A lifting mast of an industrial truck comprises:

two vertical rails at a lateral distance from each other that are connected with one another by at least two cross members, wherein one of the two cross members is a bottom cross member that is located in a bottom area of the vertical rails and at least one additional cross member is provided at a distance from the bottom cross member in a vertical direction of the lifting mast, wherein a lifting carriage that is displaceable longitudinally and is provided with load handling means is located on the vertical rails, and the lifting mast, to raise and lower the lifting carriage on the vertical rails, is provided with a lifting cylinder device that is supported on the bottom cross member, wherein the lifting cylinder device is in an operational connection with a lifting arrangement that is fastened with a first end to the lifting carriage, is fastened with a second end to the lifting mast, and is reversed on the lifting cylinder device, wherein the second end of the lifting arrangement is fastened to the bottom cross member, or wherein the lifting arrangement is fastened with the second end to the additional cross member, wherein at least one traction device that transmits a tractive force is provided to connect the additional cross member with the bottom cross member, and wherein the at least one traction device comprises two traction devices oriented in a transverse direction of the lifting mast symmetrically with reference to a fastening point of the lifting arrangement on the additional cross member.

2. The lifting mast as recited in claim 1, wherein a fastening point of the lifting arrangement on the additional cross member and a fastening point of the at least one traction device on the additional cross member are aligned in a transverse direction of the lifting mast.

3. The lifting mast as recited in claim 1, wherein a contact surface of the lifting cylinder device is located on a side of the bottom cross member facing the lifting carriage, and a fastening point of the lifting arrangement or a fastening point of the at least one traction device is located on the bottom cross member on a side of the bottom cross member facing away from the lifting carriage.

4. The lifting mast as recited in claim 1, wherein the at least one traction device that transmits a tractive force is located between the vertical rails of the lifting mast.

5. The lifting mast as recited in claim 1, wherein the at least one traction device that transmits a tractive force is in the form of a cable, a belt or a chain.

6. The lifting mast as recited in claim 1, wherein the at least one traction devices that transmits a tractive force is a preformed metal section.

7. The lifting mast as recited in claim 6, wherein the preformed metal section is a connecting rod, a threaded rod, a metal tube, a steel bar, or a preformed metal section.

8. The lifting mast as recited in claim 1, wherein the at least one traction device that transmits a tractive force is connected with the bottom cross member, the additional cross member, or the bottom cross member and the additional cross member by a threaded connection.

9. The lifting mast as recited in claim 1, wherein the at least one traction device that transmits a tractive force is connected with the bottom cross member, the additional cross member, or the bottom cross member and the additional cross member by a welded connection.

10. The lifting mast as recited in claim 9, wherein a weld seam preparation for the weld connections is performed on the bottom cross member, the additional cross member, or the bottom cross member and the additional cross member.

11. The lifting mast as recited in claim 1, wherein the lifting cylinder device is fastened to the additional cross member.

12. The lifting mast as recited in claim 1, wherein the lifting cylinder device is located between the vertical rails.

13. The lifting mast as recited in claim 1, wherein the additional cross member is X-shaped.

14. The lifting mast as recited in claim 1, wherein the lifting arrangement is a lifting chain, a lifting belt, or lifting cable.

15. A lifting mast of an industrial truck comprises:

two vertical rails at a lateral distance from each other that are connected with one another by at least two cross members, wherein one of the two cross members is a bottom cross member that is located in a bottom area of the vertical rails and at least one additional cross member is provided at a distance from the bottom cross member in a vertical direction of the lifting mast, wherein a lifting carriage that is displaceable longitudinally and is provided with load handling means is located on the vertical rails, and the lifting mast, to raise and lower the lifting carriage on the vertical rails, is provided with a lifting cylinder device that is supported on the bottom cross member, wherein the lifting cylinder device is in an operational connection with a lifting arrangement that is fastened with a first end to the lifting carriage, is fastened with a second end to the lifting mast, and is reversed on the lifting cylinder device, wherein the second end of the lifting arrangement is fastened to the bottom cross member or wherein the lifting arrangement is fastened with the second end to the additional cross member, wherein at least one traction device that transmits a tractive force is provided to connect the additional cross member with the bottom cross member, and wherein the at least one traction device that transmits a tractive force is located inside a transverse dimension of the lifting cylinder device.

* * * * *